US008408195B2

(12) United States Patent
McPherson

(10) Patent No.: US 8,408,195 B2
(45) Date of Patent: Apr. 2, 2013

(54) ARCHERY BOW STRING STOP

(75) Inventor: Mathew A. McPherson, Norwalk, WI (US)

(73) Assignee: MCP IP, LLC, Sparta, WI (US)

( * ) Notice: Subject to any disclaimer, the term of this patent is extended or adjusted under 35 U.S.C. 154(b) by 103 days.

(21) Appl. No.: 12/718,847

(22) Filed: Mar. 5, 2010

(65) Prior Publication Data

US 2010/0224178 A1 Sep. 9, 2010

Related U.S. Application Data

(60) Provisional application No. 61/157,852, filed on Mar. 5, 2009.

(51) Int. Cl.
*F41B 5/20* (2006.01)

(52) U.S. Cl. ..... 124/86; 124/89

(58) Field of Classification Search ..... 124/23.1, 124/25.6, 86, 88, 89
See application file for complete search history.

(56) References Cited

U.S. PATENT DOCUMENTS

| | | | | |
|---|---|---|---|---|
| 1,044,412 | A | 11/1912 | Newton | |
| 1,211,480 | A | 1/1917 | Newton | |
| 1,232,000 | A | 7/1917 | Chase | |
| 1,354,469 | A | 10/1920 | Joseph | |
| 1,918,652 | A | 7/1933 | Marbach | |
| 4,054,121 | A | 10/1977 | Hoyt, Jr. | |
| 4,061,125 | A | 12/1977 | Trotter | |
| 4,377,152 | A | 3/1983 | Saunders | |
| 4,461,267 | A | 7/1984 | Simonds et al. | |
| 4,628,892 | A | 12/1986 | Windedahl et al. | |
| 5,002,035 | A | 3/1991 | Brooks | |
| 5,010,622 | A | 4/1991 | Morita | |
| 5,016,602 | A | 5/1991 | Mizek | |
| 5,178,122 | A | 1/1993 | Simonds | |
| 5,320,085 | A | 6/1994 | Hanneman | |
| 5,392,757 | A | 2/1995 | Head et al. | |
| 5,452,704 | A | 9/1995 | Winebarger | |
| 5,531,211 | A | 7/1996 | Wilfong, Jr. | |
| 5,535,731 | A | 7/1996 | Webster | |
| 5,649,527 | A | 7/1997 | Olsen et al. | |
| 5,720,269 | A | 2/1998 | Saunders | |
| 5,975,070 | A | 11/1999 | Sands | |
| 5,992,403 | A * | 11/1999 | Slates | 124/89 |

(Continued)

OTHER PUBLICATIONS

U.S. Appl. No. 61/157,852, filed Mar. 5, 2009; Inventor: Mathew A. McPherson.

(Continued)

*Primary Examiner* — John Ricci
(74) *Attorney, Agent, or Firm* — Vidas, Arrett & Steinkraus

(57) ABSTRACT

A string stop for use with an archery bow comprises a body portion configured for attachment to the archery bow and a bumper attached to the body portion. The bumper is configured to contact a bowstring of the archery bow. The bumper defines an internal cavity configured to optionally receive an insert member. In some embodiments, an insert member is positioned in the cavity. The insert member can have different properties than the bumper.

22 Claims, 6 Drawing Sheets

U.S. PATENT DOCUMENTS

| | | | | |
|---|---|---|---|---|
| 6,092,516 | A | 7/2000 | Martin et al. | |
| 6,298,842 | B1 | 10/2001 | Sims | |
| 6,382,201 | B1 | 5/2002 | McPherson et al. | |
| 6,425,385 | B1 | 7/2002 | Gallops, Jr. | |
| 6,634,348 | B2 | 10/2003 | Gallops, Jr. | |
| 6,745,757 | B2 | 6/2004 | Sims | |
| 6,802,307 | B2 | 10/2004 | Leven | |
| 7,721,724 | B2 * | 5/2010 | Goade | 124/89 |
| 7,753,044 | B2 * | 7/2010 | Goade | 124/89 |
| 7,793,646 | B2 * | 9/2010 | Cooper et al. | 124/89 |
| 7,954,481 | B2 * | 6/2011 | Barnard | 124/88 |
| 2006/0180135 | A1 | 8/2006 | Andrews | |
| 2008/0264400 | A1 * | 10/2008 | Wright | 124/89 |
| 2009/0071458 | A1 | 3/2009 | Gordon et al. | |
| 2009/0133683 | A1 * | 5/2009 | Wright | 124/89 |

OTHER PUBLICATIONS

U.S. Appl. No. 12/248,467, filed Oct. 19, 2008; inventor: McPherson et al.

* cited by examiner

ARCHERY BOW STRING STOP

CROSS-REFERENCE TO RELATED APPLICATIONS

This application claims the benefit of U.S. Provisional Patent Application No. 61/157,852, filed Mar. 5, 2009, the entire disclosure of which is hereby incorporated herein by reference.

BACKGROUND OF THE INVENTION

This invention relates to archery bows and more specifically to an archery bow string stop accessory and/or archery bows comprising a string stop.

String stops have been used that contact a bowstring after an arrow is launched, for example helping to limit travel of the bowstring past the brace orientation. String stops provide benefits, but are also subject to drawbacks. For example, energy absorbed from the bowstring is often transferred to another member of the bow, such as the riser.

There remains a need for novel string stop designs that help to limit energy transfer and vibration that is ultimately felt by an archer. There remains a need for string stop designs that are capable of being used on various different bow models without modification of either the bow or the string stop.

All US patents and applications and all other published documents mentioned anywhere in this application are incorporated herein by reference in their entirety. U.S. patent application Ser. No. 12/248,467, filed Oct. 9, 2008, is hereby incorporated herein in its entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, a string stop for use with an archery bow comprises a body portion configured for attachment to the archery bow and a bumper attached to the body portion. The bumper is configured to contact a bowstring of the archery bow. The bumper defines an internal cavity configured to optionally receive an insert member.

In some embodiments, the body portion comprises a body member and a rod. The body member is attached to a first portion of the rod and the bumper is attached to a second portion of the rod.

In some embodiments, an axis of the rod is offset laterally from an axis that defines the engagement between the body member and the archery bow.

In some embodiments, the body member can be rotationally adjusted with respect to the archery bow, and the rod can be rotationally adjusted with respect to the body member.

In some embodiments, the string stop further comprises an insert member positioned in the internal cavity of the bumper. Desirably, the insert member comprises different damping characteristics than the bumper.

In some embodiments, the insert comprises an arcuate shape.

In some embodiments, an archery bow comprises a string stop as described herein.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
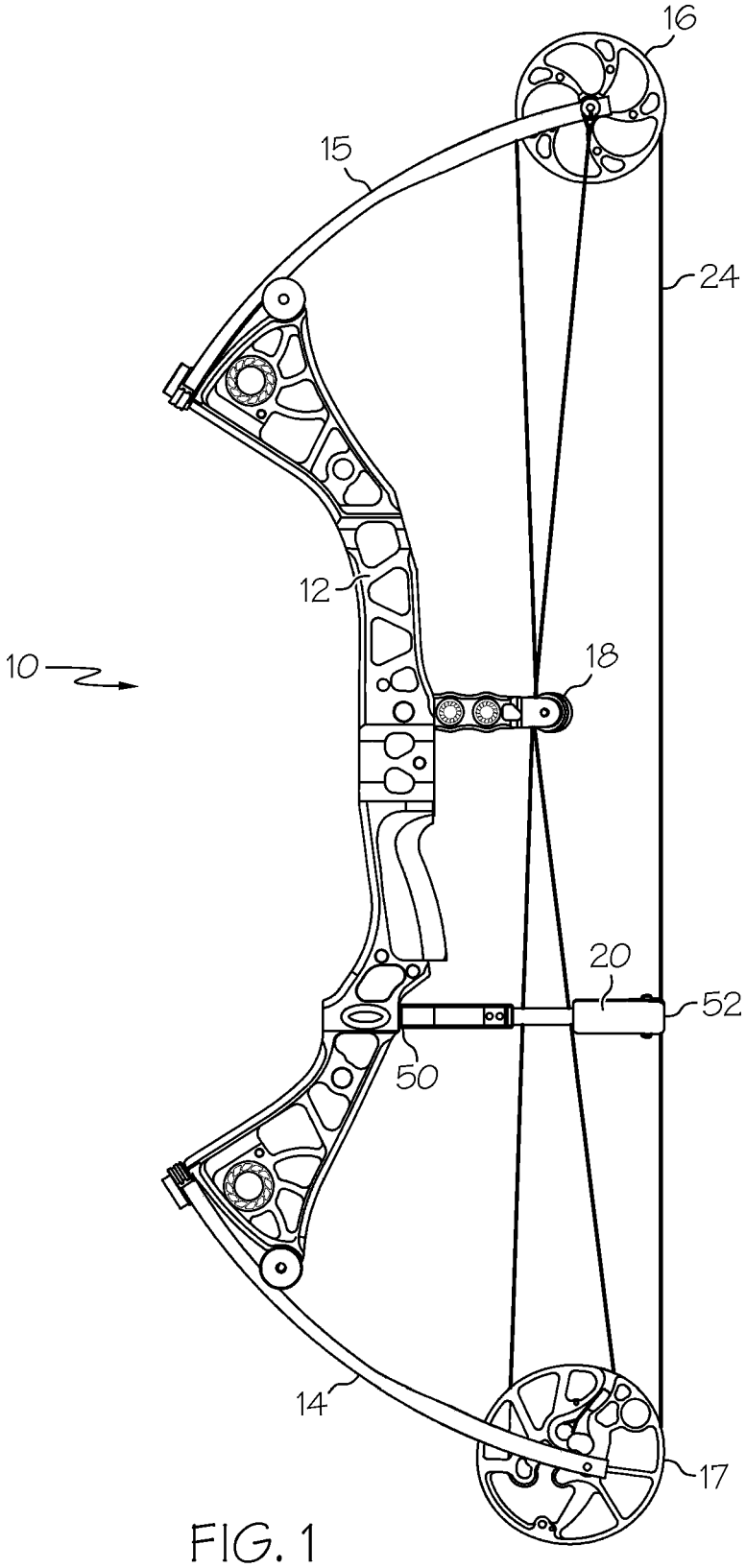
FIG. 1 shows an embodiment of an archery bow comprising a string stop.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of an archery bow 10 comprising a handle or riser 12, opposed limbs 14, 15 and opposed rotatable members 16, 17. As shown, a first rotatable member 16 comprises a pulley and a second rotable member 17 comprises a cam. A bowstring 24 extends between the rotatable members 16, 17. In some embodiments, the bow 10 comprises a cable guard 18.

The archery bow 10 further comprises a string stop 20. In some embodiments, the string stop 20 is attached at one end 50 to the riser 12 and is supported as a cantilever by the riser 12. A second end 52 of the string stop 20 extends toward the bowstring 24 and is positioned such that the bowstring 24 will contact the string stop 20 as is vibrates after an arrow is launched. In some embodiments, the string stop 20 is positioned such that it contacts the bowstring 24 when the bow is at rest.

Although a single-cam compound bow is shown in FIG. 1, the string stop 20 is suitable for use with any type of archery bow.

Figure 2:
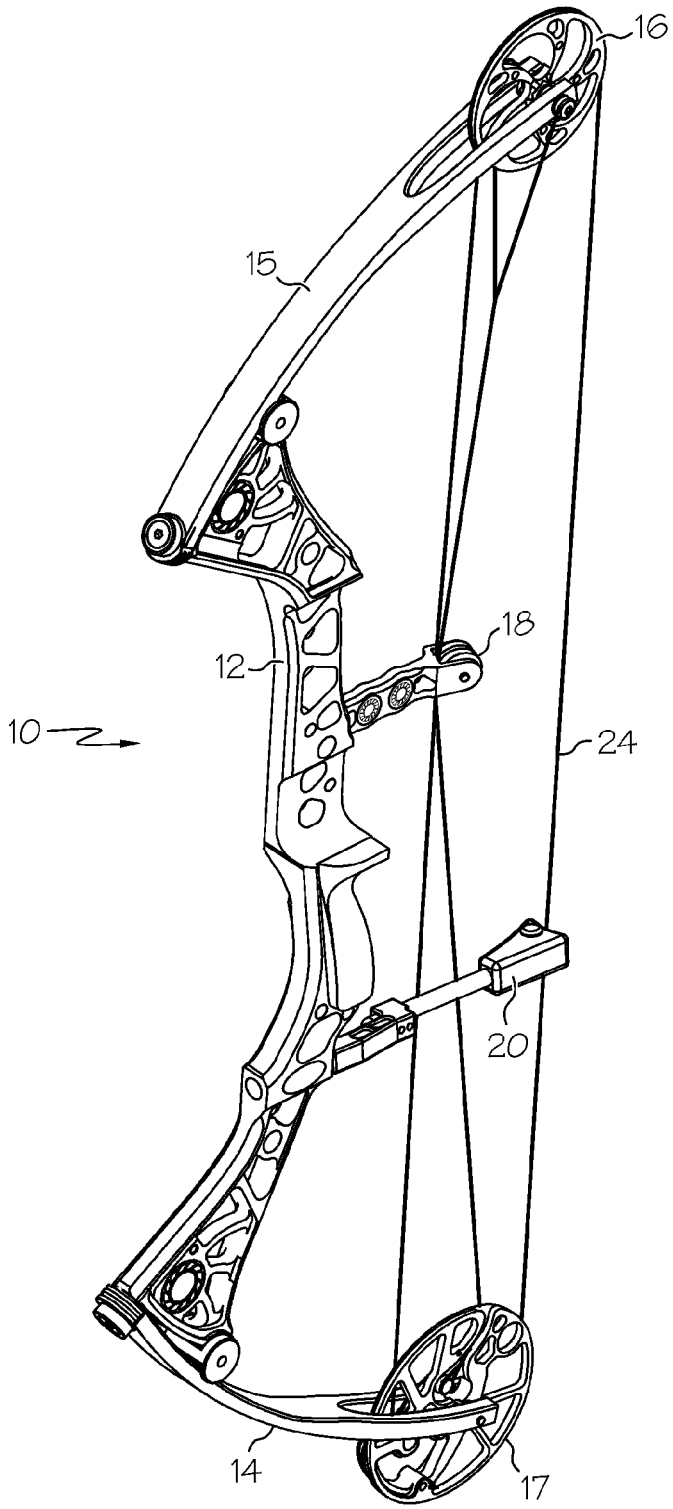
FIG. 2 shows another view of an embodiment of an archery bow comprising a string stop.

FIG. 2 shows another view of an embodiment of an archery bow 10 comprising a string stop 20.

Figure 3:
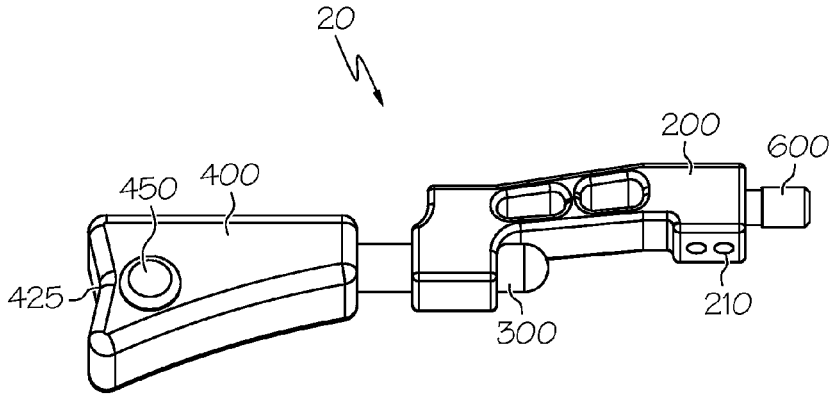
FIGS. 3 and 4 show an embodiment of a string stop.
Figure 4:
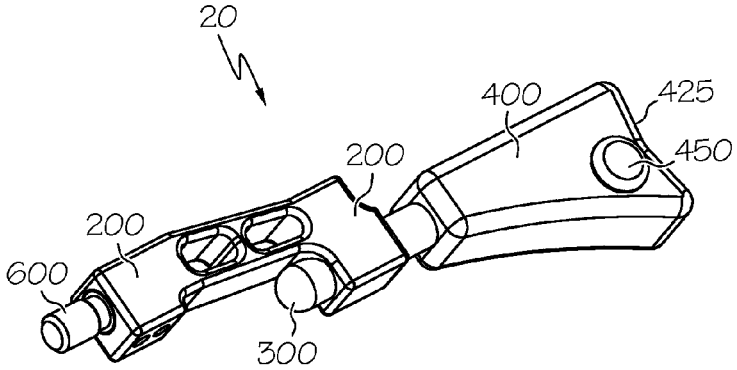

FIG. 3 shows an embodiment of a string stop 20 in greater detail. In some embodiments, the string stop 20 comprises a bumper portion 400, a main body/attachment portion 200 and a rod or shaft 300 extending between the body 200 and the bumper 400. In some embodiments, the rod 300 and body portion 200 can be collectively considered the device body.

The body portion 200 is desirably attachable to a portion of an archery bow 10, such as a riser 12. In some embodiments, the string stop 20 comprises a mounting stud 600 that can be attached to the archery bow 10, and the body portion 200 can engage the mounting stud 600. The mounting stud 600 can be configured for attachment to the bow 10 using any suitable method, such as a screw fastener. In some embodiments, the mounting stud 600 comprises threadings that can be received by complimentary threadings in the bow 10. In some embodiments, the mounting stud 600 is fixedly attached to the bow 10. In some embodiments, a thread locking compound such as Loctite® or other suitable anaerobic adhesive can be used. In some embodiments, the mounting stud 600 comprises a hex nut 650 (see FIG. 7). In some embodiments, a separate lock nut (not shown) can be used to lock the mounting stud 600 against rotation.

In some embodiments, the body portion 200 can be clamped onto the mounting stud 600. In some embodiments, a portion of the mounting stud 600 can be received in a stud cavity 28 formed in the body portion 200 (see FIG. 7). In alternative embodiments (not shown), the stud 600 can comprise a cavity that received a portion of the body portion 200. In some embodiments, one or more fasteners 210 can be used to engage the mounting stud 600 and body portion 200, such as allen screws, set screws, etc. In some embodiments, the mounting stud 600 comprises a raised flange 44 (see e.g. FIG. 7), which can enhance securement between the mounting stud 600 and the body portion 200.

The mounting stud 600 arrangement allows the string stop 20 to be highly adjustable and suitable for use on a wide range of bow 10 configurations. For example, the embodiment shown in FIG. 3 allows the orientation of the body portion 200 to be adjusted with respect to the mounting stud 600. The body portion 200 can also be rotated with respect to the mounting stud 600 and secured in any suitable rotational orientation, which allows for adjustment of the specific location of the bumper 400 with respect to the mounting stud 600. The raised flange 44 (see FIG. 7) allows the body portion 200 to engage the stud 600 at any rotational orientation.

In some embodiments, the body portion 200 can be moved along the length of the mounting stud 600, for example allowing the body portion 200 to be moved closer to the riser 12 or farther away from the riser 12. In some embodiments, the mounting stud 600 comprises a length that is greater than shown in the Figures, and the body portion 200 can comprise a larger (e.g. longer) stud cavity 28, allowing adjustment in the lengthwise direction.

The mounting stud 600 arrangement allows the string stop 20 to be quickly and easily detached from an archery bow. Thus, the body portion 200 is detachable from the mounting stud 600 without detaching the mounting stud 600 from the archery bow. Reinstallation is also quick and easy. The string stop 20 can be detached from and re-attached to the mounting stud 600 without any adjustment of other parts of the string stop 20. In some embodiments, the mounting stud 600 is suitable for use with additional embodiments of a string stop 20, or with other archery bow accessories that mount to the stud 600.

Figure 7:
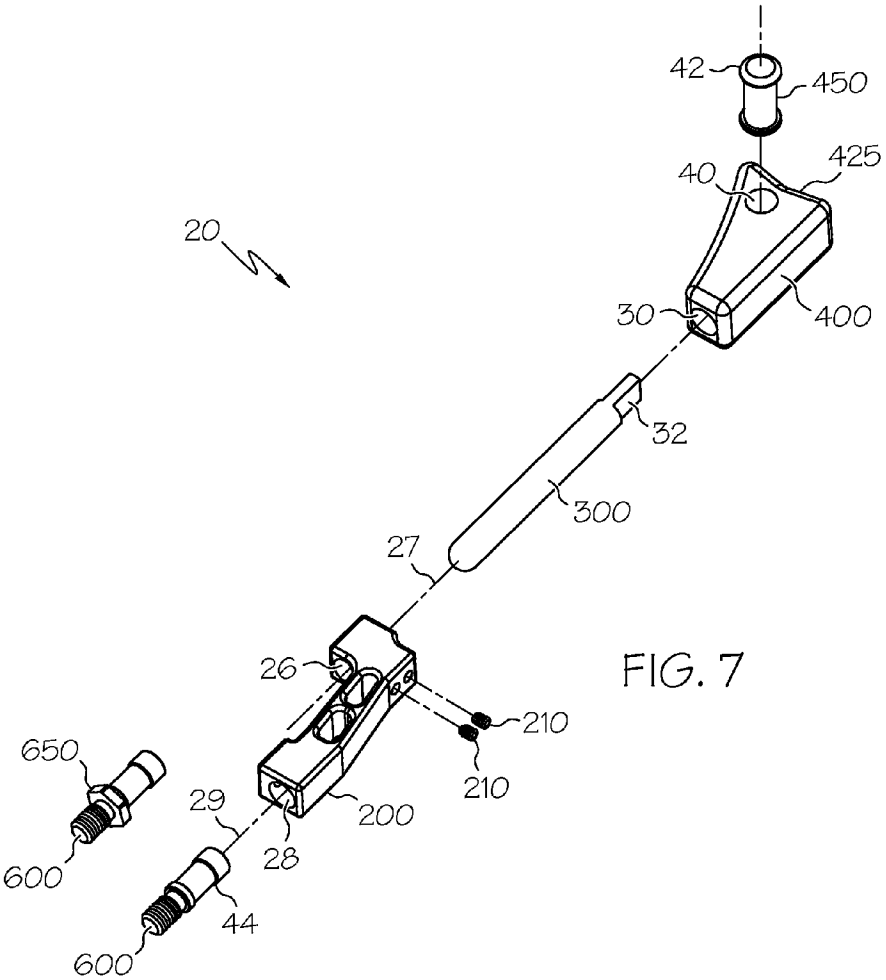
FIG. 7 shows an exploded view of an embodiment of a string stop.

The rod 300 can be received by the body portion 200, for example extending through a rod cavity or rod aperture 26 formed in the body portion 200 (see FIG. 7). The rod 300 can be secured to the body portion 200 using any suitable method, for example using one or more fasteners 210 that engage the body portion 200 and abut the rod 300, or vice versa. The rod 300 is desirably adjustable with respect to the body portion 200. The embodiment shown in FIG. 3 allows the rod 300 to be displaced along its length and rotated with respect to the body portion 200, allowing the final position of the bumper 400 to be adjusted.

In some embodiments, the stud cavity 28 is offset from the rod aperture 26. For example, a central axis of the stud cavity 28 can be offset from a central axis of the rod aperture 26. In some embodiments, the central axis 29 of the stud cavity 28 is offset from the central axis 27 of the rod aperture 26. In some embodiments, the central axis 29 of the stud cavity 28 extends parallel to the central axis 27 of the rod aperture 26. This arrangement provides for a high degree of adjustability of the final position of the bumper 400 with respect to the mounting stud 600, which allows a single version of the string stop 20 to be suitable for use with bows of different sizes and configurations.

The bumper 400 comprises a contacting surface 425 arranged to contact the bowstring 24. In some embodiments, the contacting surface 425 comprises nonparallel flat surfaces that form a V-shape or groove. In some embodiments, the contacting surface 425 comprises a curved concave surface, or a plurality of curved surfaces that meet at an angle. The shaped contacting surface 425 will help encourage the bowstring 24 to stay within a preferred vertical plane (e.g. the shooting plane) as the bowstring 24 vibrates after firing an arrow. Thus, the shaped contacting surface 425 can define a preferred rest location for the bowstring 24, such as the bottom of the V-shape. The configuration of the shaped contacting surface 425 is self-centering and encourages the bowstring 24 toward the preferred rest location, allowing the bumper 400 to absorb energy correctly.

The adjustability of the string stop 20 allows the rest location of the bumper 400 to be adjusted to properly align with the bowstring. For example, the rest location can be adjusted in a lateral direction with respect to the mounting stud 600 while maintaining the groove in a vertical orientation. The continuous rotational adjustability between the mounting stud 600 and body portion 200, combined with the continuous rotational adjustability between the body portion 200 and the rod 300 provides the string stop 20 with high configurability.

Figure 6:
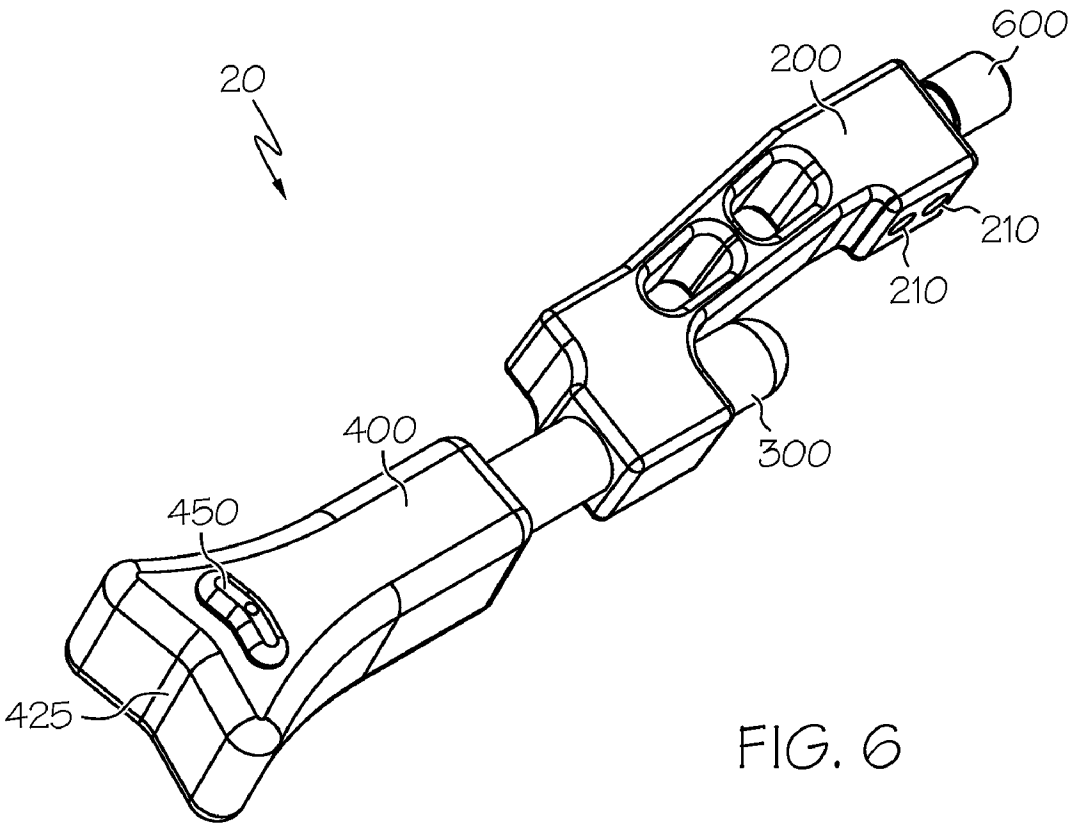
FIG. 6 shows another embodiment of a string stop.

In some embodiments, the rest location defined by the bumper 400 is in-line with the central axis 27 of the rod 300, for example as shown in FIG. 6. In some embodiments, the bumper 400 is symmetrical across a vertical plane (e.g. the bowstring plane). In some embodiments, the bumper 400 is symmetrical across the shaft axis 27.

Figure 5:
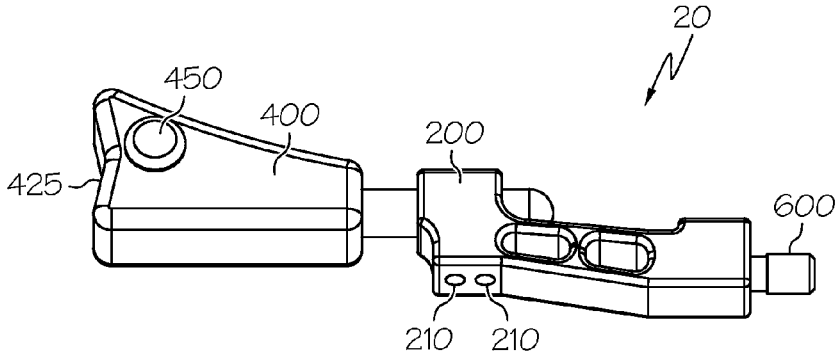
FIG. 5 shows another embodiment of a string stop.

In some embodiments, the rest location defined by the bumper 400 is offset from a central axis of the rod 300, for example as shown in FIG. 5. The offset configuration can change and reduce the amount of bowstring energy and vibration that is transferred to the rod 300, and effectively to the riser 12, allowing the bumper 400 to absorb more energy. In some embodiments, the bumper 400 is asymmetrical across a vertical plane and/or across the shaft axis 27.

Figure 8:
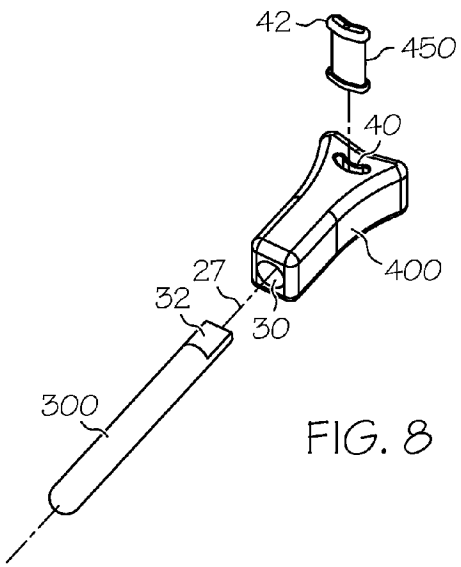
FIG. 8 shows an exploded view of a portion of an embodiment of a string stop.

Referring to FIGS. 7 and 8, the rod 300 can be attached to the bumper 400 using any suitable method. In some embodiments, the bumper 400 defines a cavity 30 for receiving the rod 300. In some embodiments, the rod 300 is frictionally engaged by the bumper 400. In some embodiments, the engagement mechanism between the bumper 400 and the rod 300 prevents rotation of the rod 300 with respect to the bumper 400. For example, the rod 300 can comprise a key or tab portion 32 that can be received in a cooperatively shaped portion of the cavity 30. In some embodiments, the shape of the key 32 prevents rotation of the bumper 400 with respect to the rod 300. Desirably, the key 32 requires a predetermined rotational orientation between the rod 300 and the bumper 400 for proper engagement.

The bumper 400 is desirably configured to receive and damp energy from the bowstring 24. As such, the bumper 400 desirably comprises a resilient material such as a rubber and/or a rubber compound, an elastomer such as a thermoplastic elastomer, a polyurethane, a styrene or any other suitable resilient material, or various combinations thereof. In some embodiments, a bumper 400 can be cast or injection molded.

In some embodiments, the bumper 400 defines an insert aperture or insert cavity 40 suitable to receive an insert 450. Various insert 450 embodiments can be used in conjunction with the bumper 400 to adjust the specific damping characteristics of the string stop 20. In some embodiments, the insert cavity 40 is aligned with a central axis of the rod 300. For example, a central axis of the insert cavity 40 can intersect a central axis of the rod 300, as shown in FIG. 8. In some embodiments, an insert cavity 40 is offset from a central axis of the rod 300, for example as shown in FIG. 7.

In some embodiments, an insert cavity 40 is aligned with a preferred rest location defined by the shaped contacting surface 425 of the bumper 400. Thus, the insert cavity 40 can be positioned directly in front of the bowstring 24. In some embodiments, an insert cavity 40 is laterally offset from the preferred rest location defined by the shaped contacting surface 425 of the bumper 400.

Desirably, material that comprises the bumper 400 is oriented between the contacting surface 425 and the insert cavity 40, such that the bowstring will contact the bumper 400 but will not contact an insert member 450 placed in the cavity 40. For example, a wall portion of the bumper 400 can be oriented between the contacting surface 425 and the insert cavity 40. In some embodiments, the contacting surface 425 can be located opposite a sidewall of said insert cavity 40. An aperture to said cavity is located on a side of the bumper 400 that does not comprise the contacting surface 425, wherein the aperture does not interrupt the contacting surface 425.

An insert cavity 40 can have any suitable shape. An insert 450 is desirably shaped cooperatively with the insert cavity 40. For example, an insert 450 and an insert cavity 40 can comprise a similar cross-sectional shape. In some embodiments, the cavity 40 defines a central axis, and the cross-sectional shape of the cavity 40 is constant along the central axis. In some embodiments, the cavity 40 comprises a cylindrical shape. In some embodiments, the cavity 40 comprises an arcuate shape. In some embodiments, the insert 450 includes curvature about an axis that is parallel to the bowstring or bowstring axis (e.g. at a brace orientation). In some embodiments, a portion of the body 200 in contact with the bumper 400 defines a longitudinal axis that is nonparallel to the central axis of the cavity 40. For example, as shown in FIG. 7, the rod 300 contacts the bumper 400 and defines a longitudinal axis (e.g. 27) that is nonparallel to the central axis of the cavity 40. In some embodiments, a longitudinal axis of the rod 300 is perpendicular to the central axis of the cavity 40. In some embodiments, the central axis of the cavity 40 is parallel to a bowstring or bowstring axis (e.g. at a brace orientation of the bow).

An insert 450 can be made of any suitable material, such as the materials suitable for the bumper 400. Desirably, the insert 450 is configured to have properties that are different from that of the bumper 400. Various combinations of bumper 400 material and insert 450 material can be selected, resulting in a range of damping and energy absorption characteristics.

In some embodiments, a plurality of various inserts 450 can be provided, allowing a user to change the characteristics of the string stop 20.

In some embodiments, the cavity 40 can be left empty.

In some embodiments, an insert 450 comprises a material having a greater capacity for damping than that of the bumper 400. In some embodiments, the insert 450 absorbs energy not only through deformation, but also by frictional resistance between the insert 450 and the bumper 400. In some embodiments, the bumper 400 comprises a material that provides greater abrasion resistance and the insert 450 comprises a material that provides greater damping and energy absorption.

In some embodiments, the bumper 400 comprises a flexible styrene, for example having a durometer of 30 A. An insert 450 comprises a similar material, such as flexible styrene, but having different properties, such as a lower durometer. In some embodiments, an insert 450 comprises a flexible styrene, for example having a durometer of 15 A.

In some embodiments, the bumper 400 comprises a thermoplastic elastomer such as Monprene® MP-1037-FL elastomer, available from Teknor Apex Company, 505 Central Ave, Pawtucket, R.I. 02861. An insert 450 comprises a thermoplastic elastomer such as Monprene® MP-1736R elastomer, also available from Teknor Apex Company.

In some embodiments, the bumper 400 comprises a durometer of 37 A. In some embodiments, an insert 450 comprises a durometer of 20 A.

In some embodiments, the bumper 400 exhibits a higher tensile strength than the insert 450. In some embodiments, the bumper 400 exhibits a tensile stress of 400 psi at 300% strain, and the insert exhibit a tensile stress of 150 psi at 300% strain. In some embodiments, the ultimate tensile strength of the bumper 400 is 1300 psi and the ultimate tensile strength of the insert 450 is 400 psi.

In some embodiments, an insert 450 comprises at least one raised flange 42. In some embodiments, an insert comprises a raised flange 42 at each end. The insert 450 can be sized such that the raised flanges 42 abut opposed surfaces of the bumper 400, thereby securing the insert 450 in place. In some embodiments, an insert 450 extends outwardly from the bumper 400. For example, the flanges 42 can be positioned outside of the cavity 40.

Figure 9:
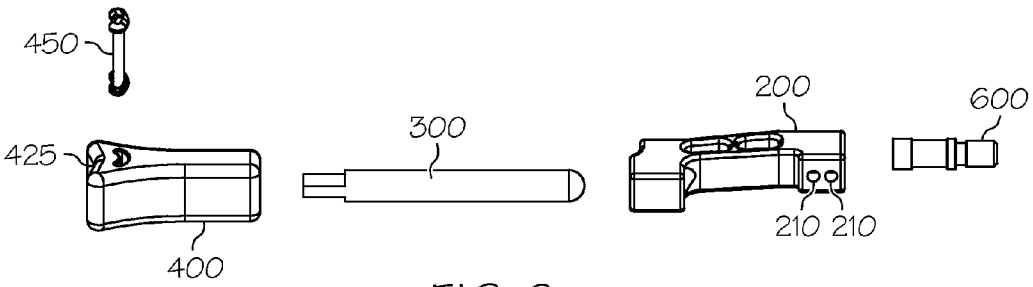
FIG. 9 shows an exploded view of another embodiment of a string stop.
Figure 10:
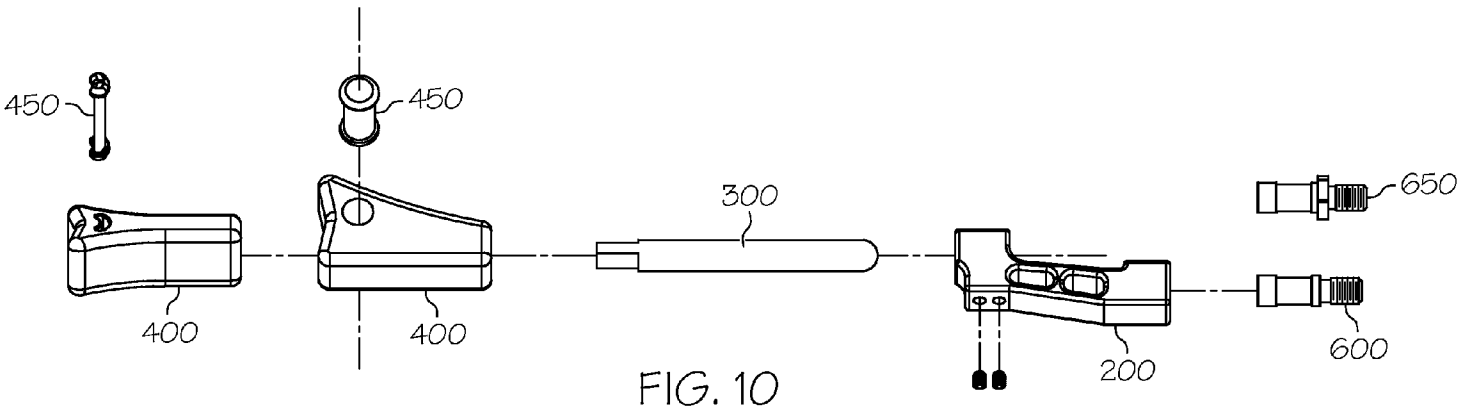
FIG. 10 shows an exploded view of another embodiment of a string stop.

In some embodiments, an insert 450 comprises an arcuate shape, for example as shown in FIGS. 8 and 9. In some embodiments, a cavity 40 comprises a similar arcuate shape, wherein the arc extends around a rest location for the bowstring. For example, the arcuate shape can be oriented such that the arc is concave with respect to the contacting surface 425. In some embodiments, the arcuate shape can be oriented such that the arc is convex with respect to the contacting surface 425.

In some embodiments, the string stop 20 comprises distinctive coloring. For example, in some embodiments, the bumper 400 comprises a first color and an insert 450 comprises a second color different from the first color.

In some embodiments, the string stop 20 comprises a harmonic damper as disclosed in U.S. Pat. No. 6,382,201, the entire disclosure of which is hereby incorporated herein in its entirety.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A string stop for use with an archery bow, the string stop comprising:

a body portion configured for attachment to the archery bow;

a bumper attached to the body portion, the bumper configured to contact a bowstring of the archery bow, the bumper defining an internal cavity, said internal cavity defining a central axis; and an insert member positioned in said internal cavity;

wherein a portion of said body in contact with said bumper defines a longitudinal axis, and said central axis is non-parallel to said longitudinal axis.

2. The string stop of claim 1, wherein said internal cavity is positioned in-line with a plane of bowstring travel.

3. The string stop of claim 1, wherein a surface of said bumper defines a groove configured to receive said bowstring.

4. The string stop of claim 1, wherein said body portion comprises a body member and a rod, the body member attached to a first portion of the rod, the bumper attached to a second portion of the rod.

5. The string stop of claim 4, wherein said body member defines a rod aperture, the rod extending through the rod aperture.

6. The string stop of claim 5, wherein said body member defines a mounting aperture configured to receive a mount for attaching said string stop to said archery bow, the mounting aperture defining a central axis that is offset from a central axis of said rod aperture.

7. The string stop of claim 4, wherein a central axis of said rod is oriented in a plane of bowstring travel.

8. The string stop of claim 1, comprising a mounting stud configured for attachment to said archery bow, said body portion comprising a mounting aperture configured to receive said mounting stud.

9. The string stop of claim 1, wherein the bumper comprises a material having different elastic properties than said insert.

10. An archery bow comprising the string stop recited in claim 1.

11. The string stop of claim 1, wherein said longitudinal axis is perpendicular to said central axis.

12. A string stop for use with an archery bow, the string stop comprising:

a body portion configured for attachment to the archery bow;

a bumper attached to the body portion, the bumper configured to contact a bowstring of the archery bow, the bumper defining an internal cavity configured to optionally receive an insert member;

wherein said internal cavity is laterally offset from a plane of bowstring travel.

13. A string stop for use with an archery bow, the string stop comprising:

a body portion configured for attachment to the archery bow, said body portion comprising a body member and a rod, the body member attached to a first portion of the rod, the bumper attached to a second portion of the rod;

a bumper attached to the body portion, the bumper configured to contact a bowstring of the archery bow, the bumper defining an internal cavity configured to optionally receive an insert member;

wherein said second portion of said rod comprises a shaped key, said bumper comprising a complimentary shape to receive the shaped key, said shaped key and said complimentary shape requiring a predetermined rotational orientation between said rod and said bumper for proper engagement.

14. A string stop for use with an archery bow, the string stop comprising:

a body portion configured for attachment to the archery bow, said body portion comprising a body member and a rod, the body member attached to a first portion of the rod, the bumper attached to a second portion of the rod;

a bumper attached to the body portion, the bumper configured to contact a bowstring of the archery bow, the bumper defining an internal cavity configured to optionally receive an insert member;

wherein a central axis of said rod is offset from and parallel to a plane of bowstring travel.

15. A string stop for use with an archery bow, the string stop comprising:

a body portion configured for attachment to the archery bow;

a bumper attached to the body portion, the bumper configured to contact a bowstring of the archery bow, the bumper defining an internal cavity configured to optionally receive an insert member;

a mounting stud configured for attachment to said archery bow, said body portion comprising a mounting aperture configured to receive said mounting stud;

said mounting stud comprising a raised flange configured to engage a fastener.

16. A string stop for use with an archery bow, the string stop comprising:

a body portion configured for attachment to the archery bow;

a bumper attached to the body portion, the bumper configured to contact a bowstring of the archery bow, the bumper defining an internal cavity;

an insert member positioned in said internal cavity;

wherein said insert comprises at least one flange that abuts a surface of said bumper.

17. A string stop for use with an archery bow, the string stop comprising:

a body portion configured for attachment to the archery bow;

a bumper attached to the body portion, the bumper configured to contact a bowstring of the archery bow, the bumper defining an internal cavity;

an insert member positioned in said internal cavity;

wherein said insert comprises an arcuate shape having curvature about an axis that is parallel to an axis of a bowstring of the archery bow.

18. The string stop of claim 17, wherein said insert is concave with respect to the surface of the bumper configured to contact the bowstring.

19. An archery bow comprising:

a riser;

a mounting stud attached to said riser, said mounting stud comprising a raised flange configured to engage a fastener;

a string stop engaged to said mounting stud, wherein said string stop is removable from said mounting stud without detaching said mounting stud from said riser.

20. The archery bow of claim 19, said string stop comprising a body member, a rod and a bumper attached to the rod, the body member comprising a stud cavity for receiving said mounting stud and a rod aperture for receiving said rod, the stud cavity defining a central axis that is offset from a central axis of the rod aperture.

21. A string stop for use with an archery bow, the string stop comprising:

a body portion configured for attachment to the archery bow;

a bumper attached to the body portion, the bumper comprising a contacting surface configured to contact a bowstring of the archery bow, the bumper defining an internal cavity configured to optionally receive an insert member;

wherein an aperture of said cavity is located on a side of said bumper that does not comprise said contacting surface and said contacting surface is located opposite a sidewall of said cavity.

22. An archery bow comprising:

a bowstring defining a bowstring axis when said bow is in a brace orientation; and a string stop comprising:

a body portion configured for attachment to the archery bow;

a bumper attached to the body portion and oriented to limit bowstring travel, the bumper defining an internal cavity configured to optionally receive an insert member, the internal cavity having a central axis oriented parallel to said bowstring axis; and said insert member, wherein said insert member is constructed and arranged to be retained in said internal cavity.

* * * * *